US011790852B1

(12) United States Patent
Zhou et al.

(10) Patent No.: US 11,790,852 B1
(45) Date of Patent: Oct. 17, 2023

(54) DISPLAY PANEL, DISPLAY MODULE, AND DISPLAY DEVICE

(71) Applicant: HKC CORPORATION LIMITED, Guangdong (CN)

(72) Inventors: Renjie Zhou, Guangdong (CN); Haoxuan Zheng, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/330,980

(22) Filed: Jun. 7, 2023

(30) Foreign Application Priority Data

Sep. 26, 2022 (CN) ..... 202211175495.2

(51) Int. Cl.
*G09G 3/32* (2016.01)
*G09G 3/3258* (2016.01)
*G09G 3/20* (2006.01)

(52) U.S. Cl.
CPC ..... *G09G 3/3258* (2013.01); *G09G 3/2096* (2013.01); *G09G 2300/0852* (2013.01); *G09G 2300/0861* (2013.01); *G09G 2310/02* (2013.01); *G09G 2310/08* (2013.01); *G09G 2320/043* (2013.01); *G09G 2330/021* (2013.01)

(58) Field of Classification Search
CPC ..... G09G 3/3258; G09G 3/2096; G09G 2300/0852; G09G 2300/0861; G09G 2310/02; G09G 2310/08; G09G 2320/043; G09G 2330/021
See application file for complete search history.

(56) References Cited

U.S. PATENT DOCUMENTS

2005/0219212 A1 10/2005 Koll et al.
2007/0058095 A1 3/2007 Miles
(Continued)

FOREIGN PATENT DOCUMENTS

CN 101923826 A 12/2010
CN 102436796 A 5/2012
(Continued)

OTHER PUBLICATIONS

Zhijun Zhu, et al., A new type of flat panel display-surface conduction electron emission display screen SED, Mar. 20, 2008.
(Continued)

*Primary Examiner* — Hong Zhou
(74) *Attorney, Agent, or Firm* — HAUPTMAN HAM, LLP

(57) ABSTRACT

A display panel is provided in embodiments of the disclosure and includes multiple pixel units arranged in a matrix. The multiple pixel units are configured to receive data signals for image display. Each of the multiple pixel units includes a first display unit and a second display unit. The first display unit and the second display unit are connected in parallel between a first drive-voltage end and a second drive-voltage end. The first drive-voltage end is configured to receive a first drive voltage, and the second drive-voltage end is configured to receive a second drive voltage. During continuous display of two frames of images, when a first frame of image in the two frames of images is displayed, the first drive voltage is greater than the second drive voltage, and the first drive voltage and the second drive voltage cooperate to drive the first display unit to perform image display.

20 Claims, 5 Drawing Sheets

(56) References Cited

U.S. PATENT DOCUMENTS

| | | | | |
|---|---|---|---|---|
| 2015/0206476 | A1* | 7/2015 | Qi | G09G 3/3258 345/82 |
| 2015/0325169 | A1* | 11/2015 | Qing | G09G 3/32 345/76 |
| 2016/0019844 | A1* | 1/2016 | Yang | G09G 3/3233 345/82 |
| 2020/0221166 | A1* | 7/2020 | Park | H04N 21/41407 |
| 2020/0258447 | A1* | 8/2020 | Chang | G09G 3/3291 |
| 2021/0104185 | A1 | 4/2021 | Park | |

FOREIGN PATENT DOCUMENTS

| | | | |
|---|---|---|---|
| CN | 103325340 | A | 9/2013 |
| CN | 103366682 | A | 10/2013 |
| CN | 103531148 | A | 1/2014 |
| CN | 203480803 | U | 3/2014 |
| CN | 103824547 | A | 5/2014 |
| CN | 203850815 | U | 9/2014 |
| CN | 107507568 | A | 12/2017 |
| CN | 107833563 | A | 3/2018 |
| CN | 108922476 | A | 11/2018 |
| CN | 113557561 | A | 10/2021 |
| CN | 113571005 | A | 10/2021 |
| CN | 114038414 | A | 2/2022 |
| CN | 114937431 | A | 8/2022 |
| KR | 20190056551 | A | 5/2019 |

OTHER PUBLICATIONS

The first office action issued in corresponding CN application No. 202211175495.2 dated Nov. 11, 2022.

Notice of allowance issued in corresponding CN application No. 202211175495.2 dated Nov. 22, 2022.

WIPO, International Search Report and Written Opinion for International Application No. PCT/CN2023/094775, dated Jul. 23, 2023.

* cited by examiner

DISPLAY PANEL, DISPLAY MODULE, AND DISPLAY DEVICE

CROSS-REFERENCE TO RELATED APPLICATION(S)

This application claims priority under 35 U.S.C. § 119(a) to Chinese Patent Application Serial No. 202211175495.2, filed Sep. 26, 2022, the entire disclosures of which is incorporated herein by reference.

TECHNICAL FIELD

The disclosure relates to the field of display technologies, and in particular, to a display panel, a display module, and a display device.

BACKGROUND

Organic Light-Emitting Diode (OLED) display devices have advantages of self-illumination, low drive voltage, high light-emitting efficiency, quick response, high clarity and high contrast, a viewing angle proximate to 180 degrees, a wide operating-temperature range, flexible displays, large-area full-color displays, etc., and thus are considered to be the most promising display devices in the industry.

Currently, OLEDs in a display panel are generally driven by Direct Current (DC), which leads to continuous operation of Thin Film Transistors (TFTs) in pixel units. The continuous operation of the TFTs results in continuous heat generation of the TFTs, thereby shortening the service life of the TFTs. Furthermore, since only one light-emitting diode is provided in a pixel unit, the service life of the light-emitting diode is also shortened due to continuous operation of the light-emitting diode, thereby resulting in a relatively high usage cost.

SUMMARY

In view of the above disadvantages in the related art, a display panel, a display module, and a display device are provided in the disclosure, where two Light-Emitting Diodes (LEDs) are employed in each pixel unit for alternate display.

A display panel includes multiple pixel units arranged in a matrix, and the multiple pixel units are configured to receive data signals for image display. Each of the multiple pixel units includes a first display unit and a second display unit. The first display unit and the second display unit are connected in parallel between a first drive-voltage end and a second drive-voltage end. The first drive-voltage end is configured to receive a first drive voltage. The second drive-voltage end is configured to receive a second drive voltage. During continuous display of two frames of images, when a first frame of image in the two frames of images is displayed, the first drive voltage is greater than the second drive voltage, and the first drive voltage and the second drive voltage cooperate to drive the first display unit to perform image display; when a second frame of image in the two frames of images is displayed, the second drive voltage is greater than the first drive voltage, and the first drive voltage and the second drive voltage cooperate to drive the second display unit to perform image display. The first display unit and the second display unit are configured to alternately display multiple frames of images under driving of the first drive voltage and the second drive voltage.

Optionally, the display panel further includes multiple scan lines extending in a first direction and multiple data lines extending in a second direction. The first direction is perpendicular to the second direction. The multiple pixel units are located at intersections between the multiple scan lines and the multiple data lines. The multiple pixel units are configured to receive scan signals through the scan lines and to receive the data signals for image display under the control of the scan signals. The pixel unit further includes an adjustment unit. The adjustment unit is connected to the first display unit and the second display unit in parallel between the first drive-voltage end and the second drive-voltage end. The adjustment unit is configured to make the first drive-voltage end and the second drive-voltage end be in electrical conduction when display of the first image is completed and the second image is not displayed, during the continuous display of the two frames of images, to balance electric charges between the first drive-voltage end and the second drive-voltage end.

Optionally, the first display unit includes a first signal-receiving module, a first voltage-stabilizing module, and a first light-emitting module. The first signal-receiving module is connected to the data line and the scan line, and is configured to receive the scan signal through the scan line, receive the data signal through the data line, and transfer the data signal to the first voltage-stabilizing module. The first voltage-stabilizing module is connected to the first signal-receiving module and the first light-emitting module, and is configured to receive and store the data signal from the first signal-receiving module, and to apply a stable voltage to the first light-emitting module during light emission of the first light-emitting module. The first light-emitting module is configured to emit light when the first drive voltage and the second drive voltage are applied to the first light-emitting module.

Optionally, the first display unit further includes a first conduction-control module and a second conduction-control module. The first conduction-control module is connected to the first voltage-stabilizing module and the first drive-voltage end and configured to receive a first control signal, and configured to control, according to the first control signal, the first drive-voltage end to be electrically connected to the first voltage-stabilizing module and to be electrically connected to the first light-emitting module through the first voltage-stabilizing module. The second conduction-control module is connected to the first light-emitting module and the second drive-voltage end and is configured to receive the first control signal, and configured to control the second drive-voltage end to be electrically connected to the first light-emitting module according to the first control signal. When the first drive voltage is greater than the second drive voltage, the first drive-voltage end, the first conduction-control module, the first voltage-stabilizing module, the first light-emitting module, the second conduction-control module, and the second drive-voltage end cooperate to form an output loop to drive the first light-emitting module to emit light.

Optionally, the first display unit further includes a first connection module. The first connection module is connected between the first light-emitting module and the second display unit and is configured to receive a first conduction signal, and configured to transfer, under the control of the first conduction signal, electric charges that remain in the first light-emitting module to the second display unit for image display when the light emission of the first light-emitting module ends.

Optionally, the second display unit includes a second signal-receiving module, a second voltage-stabilizing module, and a second light-emitting module. The second signal-receiving module is connected to the data line and the scan line, and is configured to receive the scan signal from the scan line, receive the data signal through the data line, and transfer the data signal to the second voltage-stabilizing module. The second voltage-stabilizing module is connected to the second signal-receiving module and the second light-emitting module, and is configured to receive and store the data signal from the second signal-receiving module, and apply a stable voltage to the second light-emitting module during light emission of the second light-emitting module. The second light-emitting module is configured to emit light when the second light-emitting module is connected to the first drive-voltage end and the second drive-voltage end.

Optionally, the second display unit further includes a third conduction-control module and a fourth conduction-control module. The third conduction-control module is connected to the second voltage-stabilizing module and the second drive-voltage end and configured to receive a second control signal, and configured to control, according to the second control signal, the second drive-voltage end to be electrically connected to the second voltage-stabilizing module and to be electrically connected to the second light-emitting module through the second voltage-stabilizing module. The fourth conduction-control module is connected to the second light-emitting module and the first drive-voltage end and is configured to receive the second control signal, and configured to control the first drive-voltage end to be electrically connected to the second light-emitting module according to the second control signal. When the second drive voltage is greater than the first drive voltage, the second drive-voltage end, the third conduction-control module, the second voltage-stabilizing module, the second light-emitting module, the fourth conduction-control module, and the first drive-voltage end cooperate to form an output loop to drive the second light-emitting module to emit light.

Optionally, the second display unit further includes a second connection module. The second connection module is connected between the second light-emitting module and the first display unit and is configured to receive a second conduction signal, and configured to transfer, under the control of the second conduction signal, electric charges that remain in the second light-emitting module to the first display unit for image display when the light emission of the second light-emitting module ends.

A display module is further provided in the disclosure. The display module includes a data drive circuit, a scan drive circuit, a display control circuit, a light-emitting controller, and the above-mentioned display panel. The data drive circuit is configured to receive a source output control signal from the display control circuit and to output the data signals according to the source output control signal. The scan drive circuit is configured to receive a gate output control signal from the display control circuit and to output scan signals according to the gate output control signal. The multiple pixel units in the display panel are configured to perform image display according to the scan signals and the data signals under the control of the light-emitting controller.

A display device is further provided in the disclosure. The display device includes a support frame, a power supply module, and the above-mentioned display module. The power supply module is configured to apply a power supply voltage to the display panel to perform image display, and the display module and the power supply module are fixed to the support frame.

Compared with the related art, by providing a first light-emitting diode and a second light-emitting diode and driving the first light-emitting diode and the second light-emitting diode with alternating current (AC) voltages respectively, two light-emitting diodes alternately emit light during continuous display of multiple frames of images, thereby effectively reducing an emission time of each light-emitting diode, prolonging the service life of the pixel unit. Further, when the two light-emitting diodes alternately emit light, electric-charge sharing can be performed between the two light-emitting diodes, so that electric charges that remain in the first light-emitting diode can be transferred to the second light-emitting diode for light emission when light emission of the first light-emitting diode ends, thereby significantly reducing the power consumption of the pixel unit during light emission.

BRIEF DESCRIPTION OF THE DRAWINGS

To describe technical solutions in embodiments of the disclosure more clearly, the following briefly introduces the accompanying drawings required for describing the embodiments. Apparently, the accompanying drawings in the following description only illustrate some embodiments of the disclosure. Those of ordinary skill in the art may also obtain other drawings based on these accompanying drawings without creative efforts.

Figure 1:
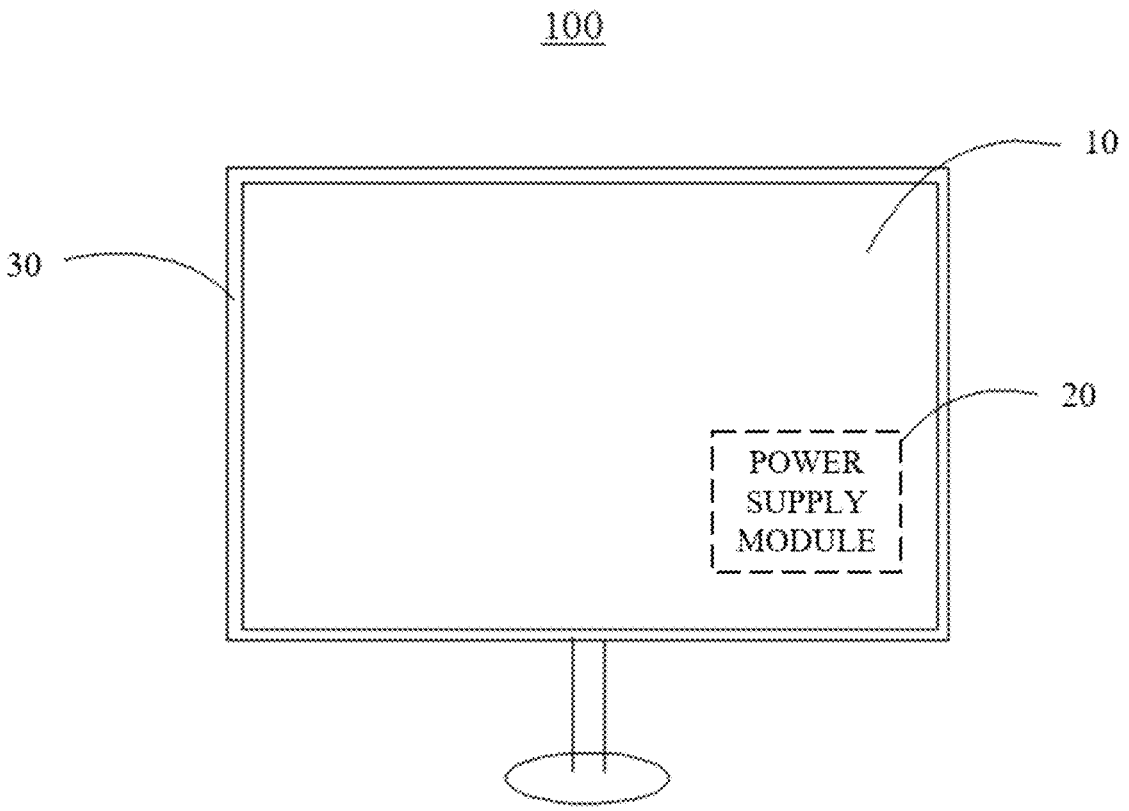
FIG. 1 is a schematic structural diagram of a display device provided in an embodiment of the disclosure.

Reference numbers are described as follows:

display device—100; display module—10; power supply module—20; support frame—30; data drive circuit—11; scan drive circuit—12; display panel—13; display region—13*a*; display control circuit—14; pixel unit—15; light-emitting controller—16; first direction—F1; second direction—F2; clock signal—CLK; data line—S; scan line—G; data signal—Data; horizontal synchronizing signal—Hsyn; vertical synchronizing signal—Vsyn; gate output control signal—Cg; source output control signal—Cs; first display unit—151; second display unit—152; adjustment unit—153; first drive voltage—V1; second drive voltage—V2; intermediate voltage—V0; first voltage value—v1; second voltage value—v2; first signal-receiving module—1511; first voltage-stabilizing module—1512; first conduction-control module—1513; second conduction-control module—1514; first light-emitting module—1515; first connection module—1516; second signal-receiving module—1521; second voltage-stabilizing module—1522; third conduction-control module—1523; fourth conduction-control module—1524; second light-emitting module—1525; second connection module—1526; first transistor—T1; second transistor—T2; first capacitor—C1; third transistor—T3; fourth transistor—T4; first light-emitting diode—D1; fifth transistor—T5; first control signal—E1; first conduction signal—K1; sixth transistor—T6; seventh transistor—T7;

eighth transistor—T8; ninth transistor—T9; tenth transistor—T10; second light-emitting diode—D2; second conduction signal—K2; eleventh transistor—T11; adjustment signal—R.

DETAILED DESCRIPTION

For ease understanding of the disclosure, the disclosure is described more completely with reference to the accompanying drawings hereinafter. The accompanying drawings illustrate preferred embodiments of the disclosure. However, the disclosure can be implemented in various forms and is not limited to the embodiments described herein. Rather, these embodiments are provided for a more thorough and comprehensive understanding of the disclosure.

The following embodiments are described with reference to the accompanying drawings to exemplify particular embodiments that may be implemented by the disclosure. The serial numbers themselves, such as "first" and "second" are used herein to distinguish the objects described, and do not have any sequential or technical meaning. The terms "connection" and "coupling" in the disclosure include direct and indirect connections (couplings), unless otherwise specified. Directional terms such as "up", "down", "front", "back", "left", "right", "inside", "outside", "side", and the like referred to herein which are only for directions with reference to the accompanying drawings. Therefore, the directional terms used herein are intended to better and more clearly illustrate and understand the disclosure, rather than explicitly or implicitly indicate that apparatus or components referred to herein must have a certain direction or be configured or operated in a certain direction and therefore cannot be understood as limitation on the disclosure.

It is noted that, in the description of the disclosure, terms "install", "couple", "connect", and "interconnect" should be understood in a broad sense unless otherwise expressly specified and limited. For example, the terms "install", "couple", "connect", and "interconnect" may refer to fixedly connect, detachably connect, or integrally connect, may refer to mechanically connect, and may refer to a directly connect, indirectly connect through an intermediate medium, or an intercommunicate interiors of two elements. For those of ordinary skill in the art, the specific meanings of the above terms in the disclosure can be understood according to specific situations. It is noted that, the terms such as "first" and "second" in the specification, claims, and the accompanying drawings of the disclosure are used for distinguishing between different objects rather than describing a particular order.

In addition, terms such as "include", "may include", "contain", or "may contain" used herein indicate the existence of the corresponding function, operation, element, etc. disclosed, and do not limit the other one or more further functions, operations, elements, etc. In addition, the term "include" or "contain" indicates the existence of the corresponding feature, number, step, operation, element, component, or combination thereof disclosed in the specification, without excluding the existence or addition of one or more other features, numbers, steps, operations, elements, components, or combinations thereof, and is intended to cover non-exclusive inclusion. In addition, when describing the embodiments of the disclosure, the term "may" is used to denote "one or more embodiments of the disclosure". Also, the term "exemplary" is intended to refer to examples or illustrations.

Unless otherwise defined, all technical and scientific terms used herein have the same meaning as commonly understood by those skilled in the art of the disclosure. The terms used herein in the disclosure are for merely describing embodiments rather than intending to limit the disclosure.

Referring to FIG. 1, FIG. 1 is a schematic structural diagram of a display device 100 provided in an embodiment of the disclosure. The display device 100 includes a display module 10, a power supply module 20, and a support frame 30. The display module 10 and the power supply module 20 are fixed to the support frame 30. The power supply module 20 is disposed at a back face of the display module 10 (i.e., a non-display face of the display module 10). The power supply module 20 is configured to apply a power supply voltage to the display module 10 for image display. The support frame 30 fixes and protects the display module 10 and the power supply module 20.

Figure 2:
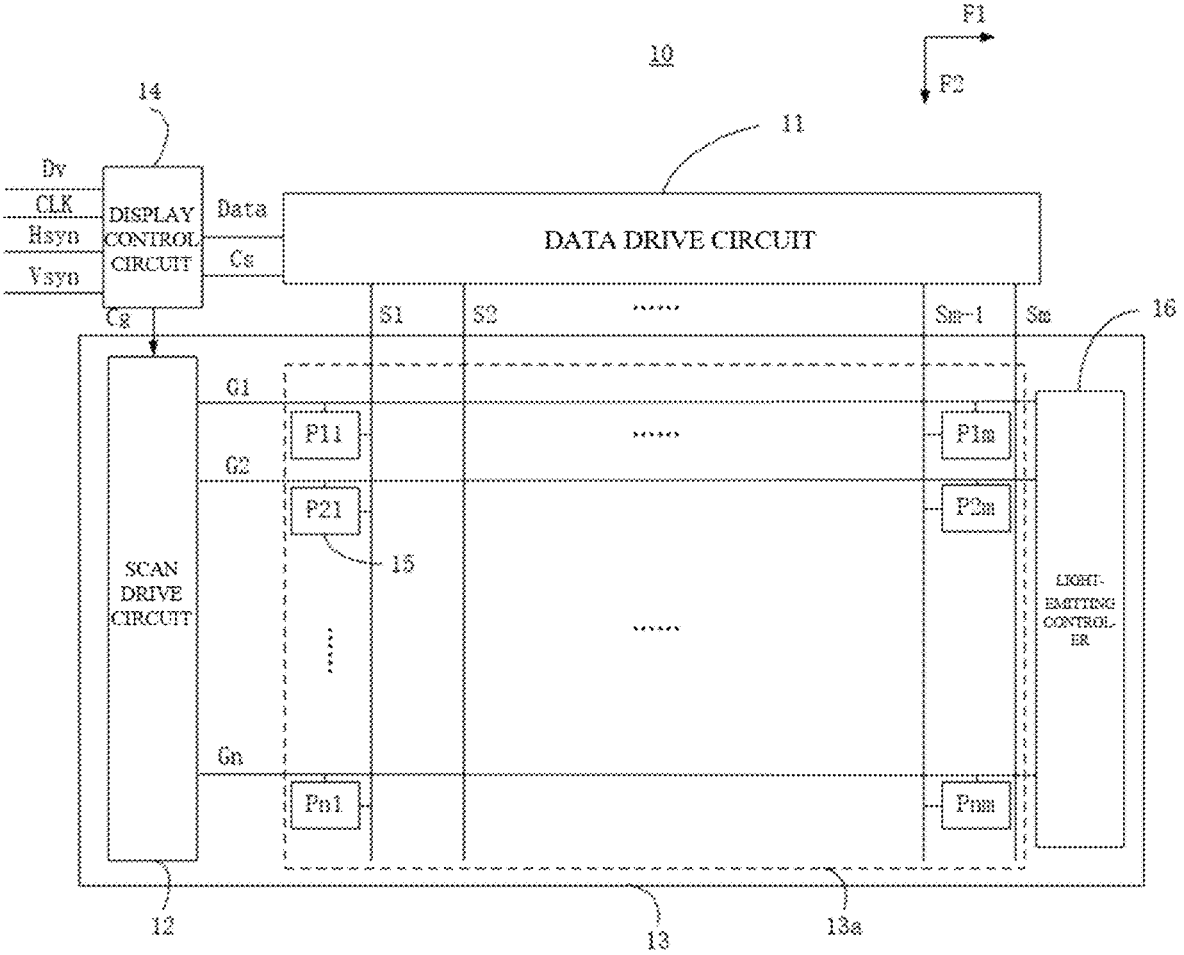
FIG. 2 is a schematic diagram illustrating a planar layout structure of the display module in FIG. 1.

Referring to FIG. 2, FIG. 2 is a schematic diagram illustrating a planar layout structure of the display module 10 in FIG. 1.

As illustrated in FIG. 2, the display module 10 includes a data drive circuit 11, a scan drive circuit 12, a display panel 13, a display control circuit 14, and a light-emitting controller 16. The data drive circuit 11, the scan drive circuit 12, the display control circuit 14, and the light-emitting controller 16 are disposed at a non-display region of the display panel 13.

In a display region 13*a* of the display panel 13, multiple data lines S1-Sm and multiple gate lines G1-Gn are arranged in a grid pattern. The multiple scan lines G1-Gn extend in a first direction F1, the multiple data lines S1-Sm extend in a second direction F2, and the first direction F1 is perpendicular to the second direction F2.

Multiple pixel units 15 are respectively located at intersections between the multiple scan lines G1-Gn and the multiple data lines S1-Sm. In the embodiment, the multiple pixel units 15 may be denoted as P11-P1*m*, P21-P2*m*, . . . , Pn1-Pnm, respectively.

The scan lines G1-Gn are connected to the scan drive circuit 12, and configured to receive scan signals from the scan drive circuit 12. The data lines S1-Sm are connected to the data drive circuit 11, and configured to receive data signals Data from the data drive circuit 11, where the data signals Data are stored and transferred in the form of a grayscale value.

Each of the pixel units 15 receives, in a predetermined time period under the control of a corresponding scan line in the scan lines G1-Gn, a data voltage corresponding to a data signal Data in the form of a grayscale value provided by a corresponding data line in the data lines S1-Sm, to perform image display.

The display control circuit 14 is configured to receive, from an external signal source, an image signal representing image information, a clock signal CLK for synchronization, a horizontal synchronizing signal Hsyn, and a vertical synchronizing signal Vsyn, and to output a gate output control signal Cg to the scan drive circuit 12, and a source output control signal Cs and the data signal Data representing image information to the data drive circuit 11. In the embodiment, the display control circuit 14 is configured to adjust original data signals to obtain the data signals Data, and to transfer the data signals Data to the data drive circuit 11.

The scan drive circuit 12 is configured to receive the gate output control signal Cg outputted by the display control circuit 14, and to output the scan signals to the scan lines G1-Gn, respectively. The data drive circuit 11 is configured to receive the source output control signal Cs outputted by the display control circuit 14 and to output the data signal Data to each of the data lines S1-Sm, where the data signal Data is utilized by a drive element of each pixel unit 15 in the display region 13*a* for image display. The data signal Data outputted to the display panel 13 is an analog grayscale voltage. The scan drive circuit 12 is configured to output the scan signal to control the pixel unit 15 to receive the data signal Data outputted by the data drive circuit 11. The light-emitting controller 16 is configured to output light-emitting control signals to the multiple pixel units 15 to control light emission of the multiple pixel units 15, so that the multiple pixel units 15 can be controlled to perform image display.

Figure 3:
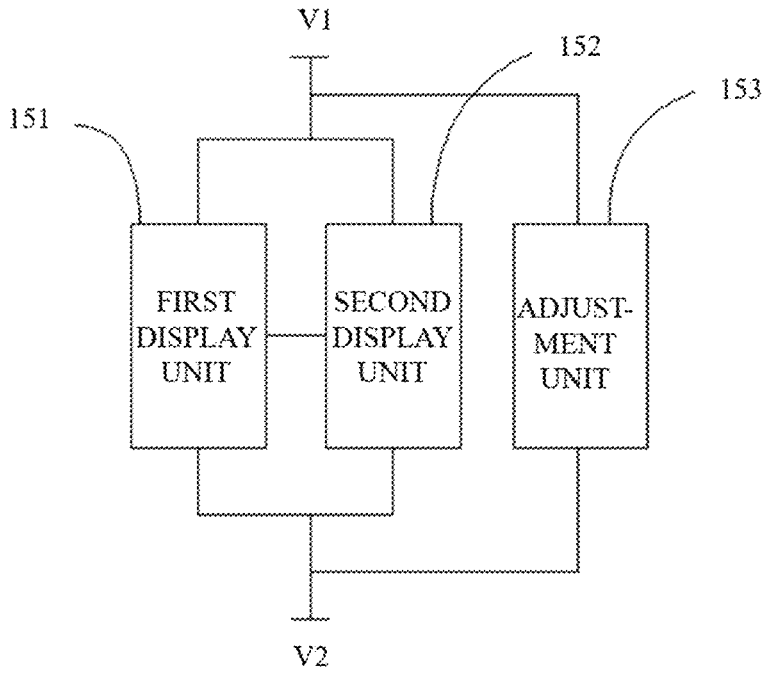
FIG. 3 is a schematic block diagram of a pixel unit in FIG. 2.

Referring to FIG. 3, FIG. 3 is a schematic diagram of the pixel unit in FIG. 2.

As illustrated in FIG. 3, the pixel unit 15 includes a first display unit 151, a second display unit 152, and an adjustment unit 153. The first display unit 151, the second display unit 152, and the adjustment unit 153 are connected in parallel between a first drive-voltage end N1 and a second drive-voltage end N2. The first drive-voltage end N1 is configured to receive a first drive voltage V1, and the second drive-voltage end N2 is configured to receive a second drive voltage V2.

The first drive voltage V1 and the second drive voltage V2 are alternating voltages. A voltage value of the first drive voltage V1 changes periodically between a first voltage value v1 and a second voltage value v2, and a voltage value of the second drive voltage V2 changes periodically between the first voltage value v1 and the second voltage value v2. In other words, the first drive voltage V1 and the second drive voltage V2 alternately change according to the same period, the same voltage, and opposite phases, where the same period is a duration of one frame of image, and the first voltage value v1 is greater than the second voltage value v2.

During continuous display of two frames of images, when a first frame of image in the two frames of images is displayed, the first drive voltage V1 is greater than the second drive voltage V2, a voltage difference from the first drive voltage V1 to the second drive voltage V2 is formed between the first drive voltage V1 and the second drive voltage V2, and the first drive voltage V1 and the second drive voltage V2 cooperate to drive the first display unit 151 to perform image display. In other words, the voltage difference is obtained by subtracting the voltage value of the second driving voltage V2 from the voltage value of the first drive voltage V1.

When a second frame of image in the two frames of images is displayed, the second drive voltage V2 is greater than the first drive voltage V1, a voltage difference from the second drive voltage V2 to the first drive voltage V1 is formed between the first drive voltage V1 and the second drive voltage V2, and the first drive voltage V1 and the second drive voltage V2 cooperate to drive the second display unit 152 to perform image display. In other words, the voltage difference is obtained by subtracting the voltage value of the first drive voltage V1 from the voltage value of the second driving voltage V2.

The first display unit 151 and the second display unit 152 are configured to alternately perform image display under driving of the first drive voltage V1 and the second drive voltage V2. That is, when the voltage value of the first drive voltage V1 is the first voltage value v1 and the voltage value of the second drive voltage V2 is the second voltage value v2, the first display unit 151 performs image display. When the voltage value of the second drive voltage V2 is the first voltage value v1 and the voltage value of the first drive voltage V1 is the second voltage value v2, the second display unit 152 performs image display.

The adjustment unit 153 is configured to receive an adjustment signal R. The adjustment unit 153 is configured to make, according to the adjustment signal R, the first drive-voltage end N1 and the second drive-voltage end N2 be in electrical conduction in a blank period in continuous display of two frames of images (i.e., when display of a first image in the two frames of images is completed and a second image in the two frames of images is not displayed), so that electric-charge sharing can be performed between the first drive voltage V1 and the second drive voltage V2 to maintain an intermediate voltage V0. In other words, the electric-charge sharing can be performed between the first drive-voltage end N1 and the second drive-voltage end N2 to maintain the intermediate voltage V0.

The first display unit 151 is electrically connected to the second display unit 152, so that electric-charge sharing can be performed between the first display unit 151 and the second display unit 152 when the first display unit 151 and the second display unit 152 perform image display alternatively. When display of the first display unit 151 is completed, electric charges that remain in the first display unit 151 are transferred to the second display unit 152 for image display. Alternatively, when display of the second display unit 152 is completed, electric charges that remain in the second display unit 152 are transferred to the first display unit 151 for image display.

During continuous display of multiple frames of images, the first display unit 151 displays a first frame of image in the multiple frames of images, then the second display unit 152 displays a second frame image in the multiple frames of images. When display of the first frame of image is completed, the first drive voltage V1 and the second drive voltage V2 change to the intermediate voltage V0 periodically. When the first drive voltage V1 and the second drive voltage V2 maintain at the intermediate voltage V0 for a preset duration, to display the second frame of image in the multiple frames of images, the second drive voltage V2 in the first drive voltage V1 and the second drive voltage V2 controls the second display unit 152 to perform image display.

The intermediate voltage V0 is an average of the first drive voltage V1 and the second drive voltage V2, that is, V0=(V1+V2)/2. In other words, a difference between the first drive voltage V1 and the intermediate voltage V0 is equal to a difference between the second drive voltage V2 and the intermediate voltage V0, the first drive voltage V1 changes periodically relative to the intermediate voltage V0, and the second drive voltage V2 changes periodically relative to the intermediate voltage V0.

Figure 4:
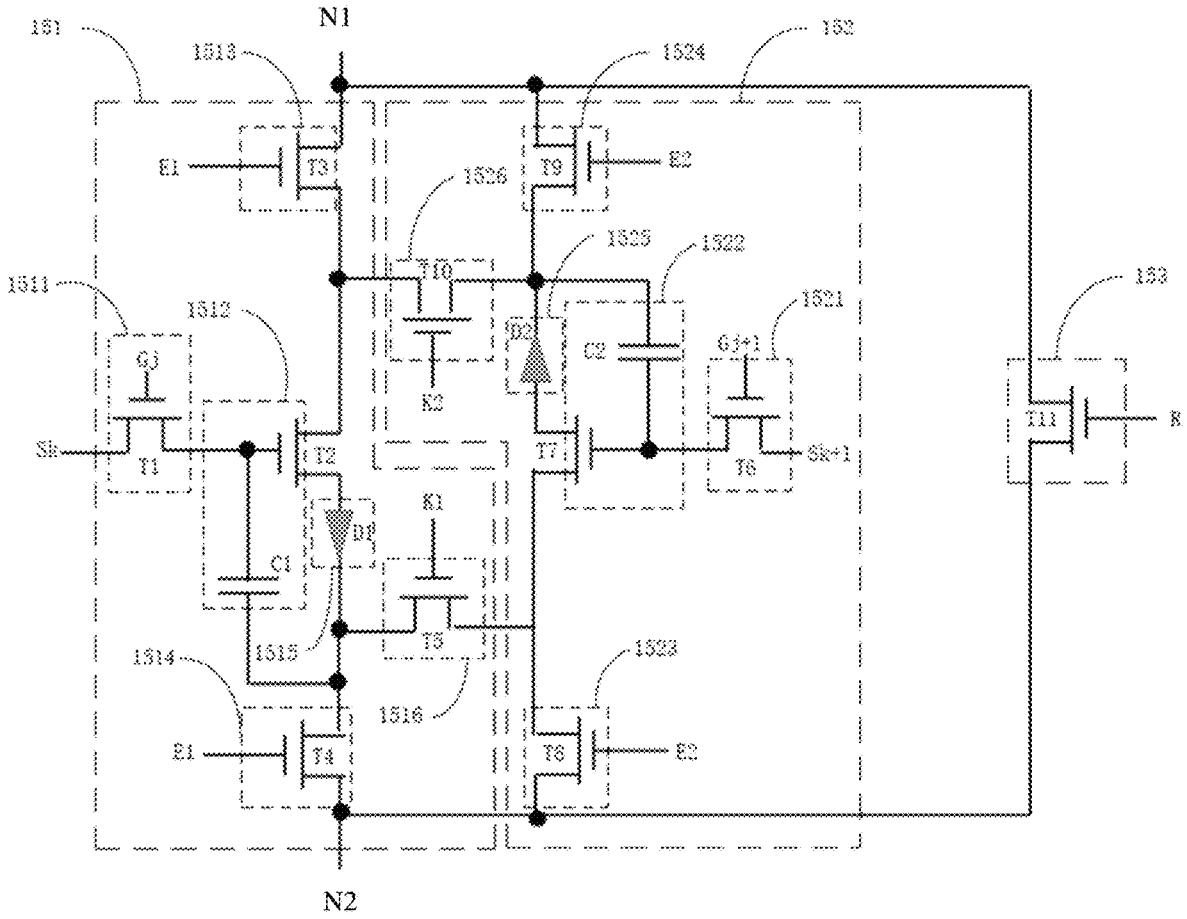
FIG. 4 is an equivalent circuit diagram of the pixel unit in FIG. 3.

Referring to FIG. 4, FIG. 4 is an equivalent circuit diagram of the pixel unit 15 in FIG. 3.

As illustrated in FIG. 4, the first display unit 151 includes a first signal-receiving module 1511, a first voltage-stabilizing module 1512, a first conduction-control module 1513, a second conduction-control module 1514, a first light-emitting module 1515, and a first connection module 1516.

The first signal-receiving module 1511 is connected to a $k^{th}$ data line Sk ($1 \le k \le m-1$) for receiving a data signal through the $k^{th}$ data line Sk and is connected to a $j^{th}$ scan line Gj ($1 \le j \le n-1$) for receiving a scan signal through the $j^{th}$ scan line.

The first voltage-stabilizing module 1512 is connected to the first signal-receiving module 1511, the first light-emitting module 1515, and the first conduction-control module 1513. The first voltage-stabilizing module 1512 is configured to receive the data signal from the first signal-receiving module 1511, and to control the first conduction-control module 1513 to be in electrical conduction with the first light-emitting module 1515 according to the data signal.

The first conduction-control module 1513 is connected to the first light-emitting module 1515 via the first voltage-stabilizing module 1512, and is configured to receive a first control signal and the first drive voltage V1. The second conduction-control module 1514 is connected to the first light-emitting module 1515, and is configured to receive the first control signal and the second drive voltage V2. The first conduction-control module 1513 and the second conduction-control module 1514 are configured to control, according to the first control signal, the first light-emitting module 1515 to receive the first drive voltage V1 and the second drive voltage V2 to form a path, so that the first light-emitting module 1515 emits light. In this case, the first drive voltage V1 is greater than the second drive voltage V2, and a current direction is from the first drive voltage V1 to the second drive voltage V2. In other words, in this case, the first drive voltage V1 is greater than the second drive voltage V2, and a current flows from the first drive-voltage end N1 to the second drive-voltage end N2.

The first connection module 1516 is connected between the first light-emitting module 1515 and the second display unit 152 and is configured to receive a first conduction signal K1. The first connection module 1516 is configured to transfer, under the control of the first conduction signal K1, electric charges that remain in the first light-emitting module 1515 to the second display unit 152 for image display when light emission of the first light-emitting module 1515 ends.

The second display unit 152 includes a second signal-receiving module 1521, a second voltage-stabilizing module 1522, a third conduction-control module 1523, a fourth conduction-control module 1524, a second light-emitting module 1525, and a second connection module 1526.

The second signal-receiving module 1521 is connected to the $(k+1)^{th}$ data line Sk+1 for receiving a data signal through the $(k+1)^{th}$ data line and is connected to the $(j+1)^{th}$ scan line Gj+1 for receiving a scan signal through the $(j+1)^{th}$ scan line.

The second voltage-stabilizing module 1522 is connected to the second signal-receiving module 1521, the second light-emitting module 1525, and the third conduction-control module 1523. The second voltage-stabilizing module 1522 is configured to receive the data signal from the second signal-receiving module 1521, and to control the third conduction-control module 1523 to be in electrical conduction with the second light-emitting module 1525 according to the data signal.

The third conduction-control module 1523 is connected to the second light-emitting module 1525 via the second voltage-stabilizing module 1522, and is configured to receive a second control signal and the second drive voltage V2. The fourth conduction-control module 1524 is connected to the second light-emitting module 1525, and is configured to receive the second control signal and the first drive voltage V1. The third conduction-control module 1523 and the fourth conduction-control module 1524 are configured to control, according to the second control signal, the second light-emitting module 1525 to receive the first drive voltage V1 and the second drive voltage V2 to form a path, so that the second light-emitting module 1525 emits light. In this case, the second drive voltage V2 is greater than the first drive voltage V1, and a current direction is from the second drive voltage V2 to the first drive voltage V1. In other words, in this case, the second drive voltage V2 is greater than the first drive voltage V1, and the current flows from the second drive-voltage end N2 to the first drive-voltage end N1.

The second connection module 1526 is connected between the second light-emitting module 1525 and the first display unit 151, and is configured to receive a second conduction signal K2. The second connection module 1526 is configured to transfer, under the control of the second conduction signal K2, electric charges that remain in the second light-emitting module 1525 to the first display unit 151 for image display when light emission of the second light-emitting module 1525 ends.

Specifically, in the first display unit 151, the first signal-receiving module 1511 includes a first transistor T1. The first voltage-stabilizing module 1512 includes a second transistor T2 and a first capacitor C1. The first conduction-control module 1513 includes a third transistor T3. The second conduction-control module 1514 includes a fourth transistor T4. The light-emitting module 1515 includes a first light-emitting diode D1. The first connection module 1516 includes a fifth transistor T5.

A gate of the first transistor T1 is connected to the $j^{th}$ scan line Gj, a source of the first transistor T1 is connected to the $k^{th}$ data line Sk, a drain of the first transistor T1 is connected to the second transistor T2, and the first transistor T1 is configured to receive a data signal from the $k^{th}$ data line Sk under the control of the scan signal and to transfer the data signal to the second transistor T2.

A gate of the second transistor T2 is connected to a drain of the first transistor T1, a source of the second transistor T2 is connected to the third transistor T3, a drain of the second transistor T2 is connected to an anode of the first light-emitting diode D1, and the source of the second transistor T2 and the drain of the second transistor T2 are controlled to be in electrical conduction according to the data signal, to control the third transistor T3 be in electrical conduction with the first light-emitting diode D1. One end of the first capacitor C1 is connected to the drain of the first transistor T1, the other end of the first capacitor C1 is connected to a cathode of the first light-emitting diode D1, and the first capacitor C1 is configured to receive the data signal from the drain of the first transistor T1 for charging of the first capacitor C1, and is configured to provide a stable voltage during light emission of the first light-emitting diode D1.

A gate of the third transistor T3 is configured to receive the first control signal E1, a source of the third transistor T3 is configured to receive the first drive voltage V1, a drain of the third transistor T3 is connected to the source of the second transistor T2, and the third transistor T3 is configured to control the source of the second transistor T2 to receive the first drive voltage V1 according to the control signal. The first drive voltage V1 is conducted to the anode of the first light-emitting diode D1 via the second transistor T2.

A gate of the fourth transistor T4 is configured to receive the first control signal E1, a source of the fourth transistor T4 is connected to the cathode of the first light-emitting diode D1, a drain of the fourth transistor T4 is configured to receive the second drive voltage V2, and the fourth transistor T4 is configured to control the cathode of the first light-emitting diode D1 to receive the second drive voltage V2 according to the first control signal E1. In other words, according to the first control signal E1, the first drive voltage V1 is controlled to be conducted to the anode of the first light-emitting diode D1 and the second drive voltage V2 is controlled to be conducted to the cathode of the first light-emitting diode D1, in this case, the first drive voltage V1 is greater than the second drive voltage V2, so that the first light-emitting diode D1 can be controlled to emit light.

A gate of the fifth transistor T5 is configured to receive the first conduction signal K1, a source of the fifth transistor T5 is connected to the cathode of the first light-emitting diode D1, a drain of the fifth transistor T5 is connected to the second display unit 152, and the fifth transistor T5 is configured to control electric charges in the first light-emitting diode D1 to be transferred to the second display unit according to the first conduction signal K1.

In the second display unit 152, the second signal-receiving module 1521 includes a sixth transistor T6. The second voltage-stabilizing module 1522 includes a seventh transistor T7 and a second capacitor C2. The third conduction-control module 1523 includes an eighth transistor T8. A fourth conduction-control module includes a ninth transistor T9. The second connection module 1526 includes a tenth transistor T10. The light-emitting module 1515 includes a second light-emitting diode D2.

A gate of the sixth transistor T6 is connected to a $(j+1)^{th}$ scan line Gj+1, a source of the sixth transistor T6 is connected to a $(k+1)^{th}$ data line Sk+1, a drain of the sixth transistor T6 is connected to the seventh transistor T7, and the sixth transistor T6 is configured to receive the data signal through the $k^{th}$ data line Sk under the control of the scan signal and to transfer the data signal to the seventh transistor T7.

A gate of the seventh transistor T7 is connected to a drain of the sixth transistor T6, a source of the seventh transistor T7 is connected to the eighth transistor T8, a drain of the seventh transistor T7 is connected to an anode of the second light-emitting diode D2, and the source of the seventh transistor T7 and the drain of the seventh transistor T7 are controlled to be in electrical conduction according to the data signal, to control the eighth transistor T8 to be in electrical conduction with the second light-emitting diode D2. One end of the second capacitor C2 is connected to the drain of the sixth transistor T6, the other end of the second capacitor C2 is connected to a cathode of the second light-emitting diode D2, and the second capacitor C2 is configured to receive the data signal from the drain of the sixth transistor T6 for charging of the second capacitor C2, and is configured to provide a stable voltage during light emission of the second light-emitting diode D2.

A gate of the eighth transistor T8 is configured to receive the second control signal E2, a source of the eighth transistor T8 is configured to receive the second drive voltage V2, and a drain of the eighth transistor T8 is connected to the source of the seventh transistor T7. The eighth transistor T8 is configured to control the source of the seventh transistor T7 to receive the second drive voltage V2 according to the control signal. The second drive voltage V2 is connected to the anode of the first light-emitting diode D1 via the seventh transistor T7.

A gate of the ninth transistor T9 is configured to receive the second control signal E2, a source of the ninth transistor T9 is connected to the cathode of the second light-emitting diode D2, a drain of the ninth transistor T9 is configured to receive the first drive voltage V1, and the ninth transistor T9 is configured to control the cathode of the second light-emitting diode D2 to receive the first drive voltage V1 according to the second control signal E2. That is, the second drive voltage V2 is controlled to be conducted to the anode of the second light-emitting diode D2 according to the second control signal E2, the first drive voltage V1 is controlled to be conducted to the cathode of the second light-emitting diode D2, and the second drive voltage V2 is greater than the first drive voltage V1, so that the second light-emitting diode D2 can be controlled to emit light.

A gate of the tenth transistor T10 is configured to receive the second conduction signal K2, a source of the tenth transistor T10 is connected to the cathode of the second light-emitting diode D2, a drain of the tenth transistor T10 is connected to the first display unit, and the tenth transistor T10 is configured to control electric charges in the second light-emitting diode D2 to be transferred to the first display unit according to the second conduction signal K2.

The source of the fifth transistor T5 is connected to the cathode of the first light-emitting diode D1, and the drain of the fifth transistor T5 is connected to the source of the seventh transistor T7. The fifth transistor T5 is configured to conduct, under the control of the adjustment signal R, electric charges that remain in the first light-emitting diode D1 to the source of the seventh transistor T7, and the electric charges are transferred through the seventh transistor T7 to the second light-emitting diode D2 for light emission.

The source of the tenth transistor T10 is connected to the cathode of the second light-emitting diode D2, the drain of the tenth transistor T10 is connected to the source of the second transistor T2, and the tenth transistor T10 is configured to conduct, under the control of the adjustment signal R, electric charges that remain in the second light-emitting diode D2 to the source of the second transistor T2, and the electric charges are transferred through the seventh transistor T7 to the first light-emitting diode D1 for light emission.

With the first connection module and the second connection module, the electric charges that remain in a circuit can be effectively utilized, so that the response speed of a light-emitting diode can be improved, and the power consumption is reduced.

The adjustment unit 153 includes an eleventh transistor T11. A gate of the eleventh transistor T11 is configured to receive the adjustment signal R, a source of the eleventh transistor T11 is connected to the first drive-voltage end N1, a drain of the eleventh transistor T11 is connected to the second drive-voltage end N2, and the source of the eleventh transistor T11 and the drain of the eleventh transistor T11 are controlled to be in conduction according to the adjustment signal R, to control the first drive-voltage end N1 to be in electrical conduction with the second drive-voltage end N2, and thus the first drive voltage V1 and the second drive voltage V2 are controlled to be reset to the intermediate voltage V0.

The first to eleventh transistors T1 to T11 are thin film transistors.

Figure 5:
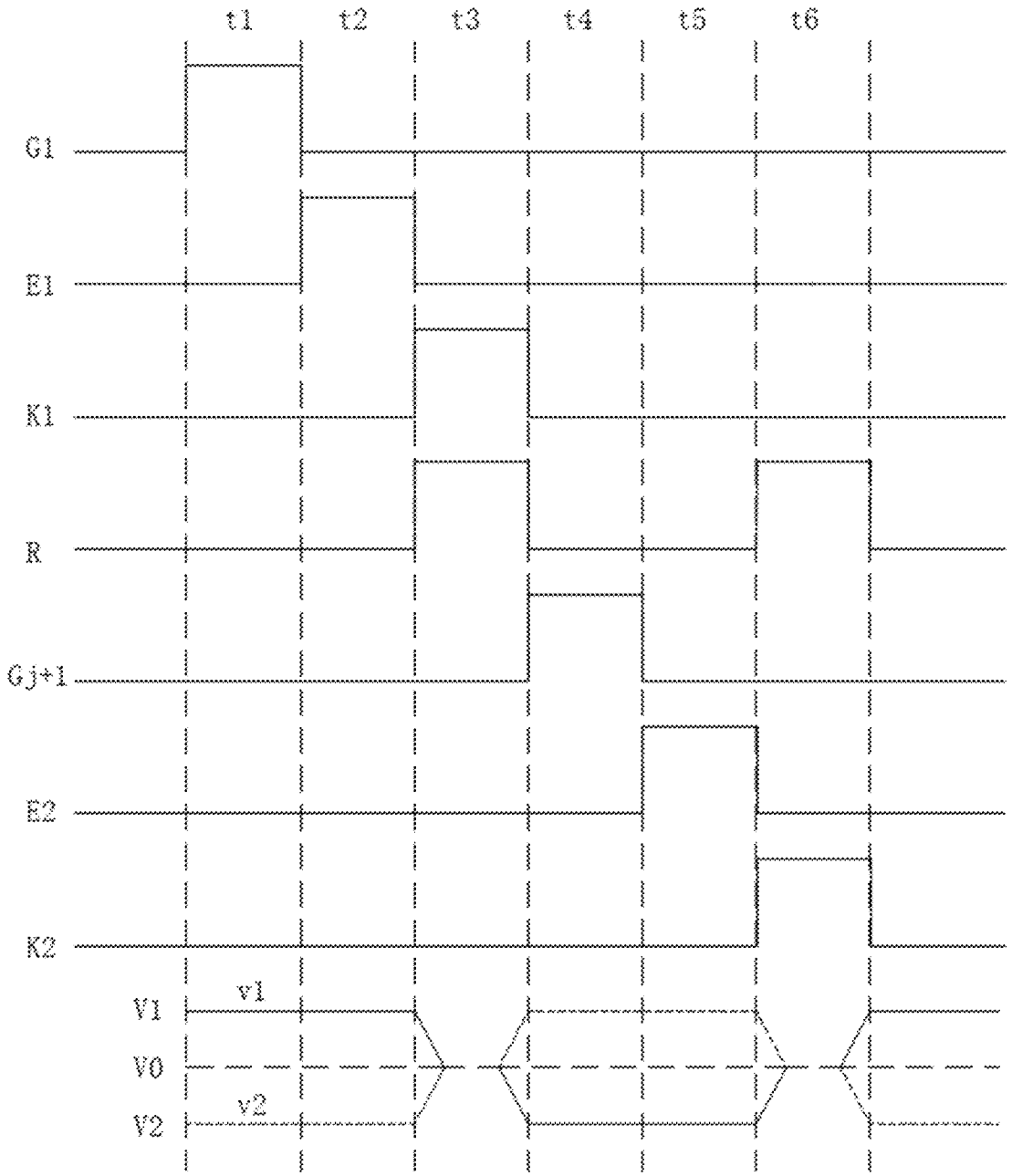
FIG. 5 is a timing diagram of signals in the pixel unit in FIG. 4.

Referring to FIG. 5, FIG. 5 is a timing diagram of signals in the pixel unit in FIG. 4.

As illustrated in FIG. 5, during image display of the pixel unit 15, in a first time period t1, the first signal-receiving module 151 of the first display unit 151 receives the scan signal from a $j^{th}$ scan line Gj, and conducts the data signal to the first voltage-stabilizing module 1512 according to the scan signal, so that the first capacitor C1 of the first voltage-stabilizing module 1512 can be charged and the source of the second transistor T2 and the drain of the second transistor T2 of the first voltage-stabilizing module 1512 can be controlled to be in electrical conduction.

In a second time period t2, the first conduction-control module 1513 and the second conduction-control module 1514 receive the first control signal E1 simultaneously, the source of the third transistor T3 and the drain of the third transistor T3 of the first conduction-control module 1513 are in electrical conduction, and the source of the fourth transistor T4 and the drain of the fourth transistor T4 of the second conduction-control module 1514 are in electrical conduction, so that the anode of the first light-emitting diode D1 of the first light-emitting module 1515 can be controlled to receive the first drive voltage V1, and the cathode of the first light-emitting diode D1 of the first light-emitting module 1515 can be controlled to receive the second drive voltage V2. At this time, the voltage value of the first drive voltage V1 is the first voltage value v1, and the voltage value of the second drive voltage V2 is the second voltage value v2, the first drive voltage V1 is greater than the second drive voltage V2, so that the first light-emitting diode D1 can be driven to emit light, i.e., to display the first frame of image.

In a third time period t3, the fifth transistor T5 of the first connection module 1516 receives the first conduction signal K1, and the source of the fifth transistor T5 and the drain of the fifth transistor T5 are controlled to be in electrical conduction according to the first conduction signal K1, so that electric charges that remain in the first light-emitting module 1515 can be transferred to a circuit of the second display unit 152 when the light emission of the first light-emitting module 1515 ends. The gate of the eleventh transistor T11 of the adjustment unit 153 receives the adjustment signal R, and the source of the eleventh transistor T11 and the drain of the eleventh transistor T11 are controlled to be in electrical conduction according to the adjustment signal R. In this way, the voltage value of the first drive voltage V1 is reset to a voltage value of the intermediate voltage V0 from the first voltage value v1, and when the voltage value of the first drive voltage V1 maintains at the voltage value of the intermediate voltage V0 for a preset duration, the voltage value of the first drive voltage V1 changes from the voltage value of the intermediate voltage V0 to the second voltage value v2; meanwhile, the voltage value of the second drive voltage V2 is reset to the voltage value of the intermediate voltage V0 from the second voltage value v2, and when the voltage value of the second drive voltage V2 maintains at the voltage value of the intermediate voltage V0 for a preset duration, the voltage value of the second drive voltage V2 changes from the voltage value of the intermediate voltage V0 to the first voltage value v1, and at this point, the voltage value of the second drive voltage V2 is greater than the voltage value of the first drive voltage V1.

In a fourth time period t4, the second signal-receiving module 1521 of the second display unit 152 receives the scan signal transferred through a $(j+1)^{th}$ scan line Gj+1, receives the data signal according to the scan signal, and transfers the data signal to the second voltage-stabilizing module 1522. The second voltage-stabilizing module 1522 charges the second capacitor C2 of the second voltage-stabilizing module 1522 according to the data signal received, and controls the source of the seventh transistor T7 and the drain of the seventh transistor T7 to be in conduction.

In a fifth time period t5, the third conduction-control module 1523 and the fourth conduction-control module 1524 receive the second control signal E2 simultaneously. The source of the eighth transistor T8 and the drain of the eighth transistor T8 of the third conduction-control module 1523 are in electrical conduction, and the source of the fourth transistor T4 and the drain of the fourth transistor T4 of the second conduction-control module 1514 are in electrical conduction. In this way, the anode of the second light-emitting diode D2 of the second light-emitting module 1525 is controlled to receive the second drive voltage V2, the cathode of the second light-emitting diode D2 of the second light-emitting module 1525 is controlled to receive the first drive voltage V1, and the second drive voltage V2 is greater than the first drive voltage V1, so that the second light-emitting diode D2 is driven to emit light (i.e., display the second frame of image).

In a sixth time period t6, the tenth transistor T10 of the second connection module 1526 receives the second conduction signal, controls the source of the tenth transistor T10 and the drain of the tenth transistor T10 to be in electrical conduction according to the second conduction signal, and transfers electric charges that remain in the second light-emitting module 1525 to a circuit of the first display unit 151 when the light emission of the second light-emitting module 1525 ends. Meanwhile, the gate of the eleventh transistor T11 of the adjustment unit 153 receives the adjustment signal R, and the source of the eleventh transistor and the drain of the eleventh transistor are controlled to be in electrical conduction according to the adjustment signal R. In this way, the voltage value of the first drive voltage V1 is reset to the voltage value of the intermediate voltage V0 from the second voltage value v2, and when the voltage value of the first drive voltage V1 maintains at the voltage value of the intermediate voltage V0 for a preset duration, the voltage value of the first drive voltage V1 changes from the voltage value of the intermediate voltage V0 to the first voltage value v1, and meanwhile, the voltage value of the second drive voltage V2 is reset from the first voltage value v1 to the voltage value of the intermediate voltage V0, and when the voltage value of the second drive voltage V2 maintains at the voltage value of the intermediate voltage V0 for a preset duration, the voltage value of the second drive voltage V2 changes from the voltage value of the intermediate voltage V0 to the second voltage value v2, and at this point, the voltage value of the first drive voltage V1 is greater than the voltage value of the second drive voltage V2.

By providing the first light-emitting diode and the second light-emitting diode and driving the first light-emitting diode and the second light-emitting diode with alternating current (AC) voltages respectively, two light-emitting diodes alternately emit light during continuous display of multiple frames of images, thereby effectively reducing an emission time of each light-emitting diode, prolonging the service life of the pixel unit. Further, when the two light-emitting diodes alternately emit light, electric-charge sharing can be performed between the two light-emitting diodes, so that electric charges that remain in the first light-emitting diode can be transferred to the second light-emitting diode for light emission when light emission of the first light-emitting diode ends, thereby significantly reducing the power consumption of the pixel unit during light emission.

It is understood that the disclosure is not to be limited to the above-identified embodiments. Those of ordinary skill in the art can make improvements or changes based on the above description, and all these improvements and changes should fall within the protection scope of the appended claims of the disclosure.

What is claimed is:

1. A display panel, comprising a plurality of pixel units arranged in a matrix, and the plurality of pixel units being configured to receive data signals for image display, wherein each of the plurality of pixel units comprises a first display unit, a second display unit, and an adjustment unit, wherein the first display unit and the second display unit are connected in parallel between a first drive-voltage end and a second drive-voltage end, the first drive-voltage end is configured to receive a first drive voltage, and the second drive-voltage end is configured to receive a second drive voltage;

during continuous display of two frames of images, when a first frame of image in the two frames of images is displayed, the first drive voltage is greater than the second drive voltage, and the first drive voltage and the second drive voltage cooperate to drive the first display unit to perform image display; when a second frame of image in the two frames of images is displayed, the second drive voltage is greater than the first drive voltage, and the first drive voltage and the second drive voltage cooperate to drive the second display unit to perform image display;

the first display unit and the second display unit are configured to alternately display a plurality of frames of images under driving of the first drive voltage and the second drive voltage; and the adjustment unit is connected to the first display unit and the second display unit in parallel between the first drive-voltage end and the second drive-voltage end, and configured to make the first drive-voltage end and the second drive-voltage end be in electrical conduction when display of the first image is completed and the second image is not displayed, during the continuous display of the two frames of images, to balance electric charges between the first drive-voltage end and the second drive-voltage end.

2. The display panel of claim 1, wherein the display panel further comprises a plurality of scan lines extending in a first direction and a plurality of data lines extending in a second direction, the first direction is perpendicular to the second direction, the plurality of pixel units are located at intersections between the plurality of scan lines and the plurality of data lines, and the plurality of pixel units are configured to receive scan signals through the scan lines and to receive the data signals for image display under the control of the scan signals.

3. The display panel of claim 2, wherein the first display unit comprises a first signal-receiving module, a first voltage-stabilizing module, and a first light-emitting module, wherein the first signal-receiving module is connected to a data line of the plurality of data lines and a scan line of the plurality of scan lines, and is configured to receive a scan signal through the scan line, receive a data signal through the data line, and transfer the data signal to the first voltage-stabilizing module; the first voltage-stabilizing module is connected to the first signal-receiving module and the first light-emitting module, and is configured to receive and store the data signal from the first signal-receiving module, and to apply a stable voltage to the first light-emitting module during light emission of the first light-emitting module; and the first light-emitting module is configured to emit light when the first drive voltage and the second drive voltage are applied to the first light-emitting module.

4. The display panel of claim 3, wherein the first display unit further comprises a first conduction-control module and a second conduction-control module, wherein the first conduction-control module is connected to the first voltage-stabilizing module and the first drive-voltage end and configured to receive a first control signal, and configured to control, according to the first control signal, the first drive-voltage end to be electrically connected to the first voltage-stabilizing module and to be electrically connected to the first light-emitting module through the first voltage-stabilizing module;

the second conduction-control module is connected to the first light-emitting module and the second drive-voltage end and is configured to receive the first control signal, and configured to control the second drive-voltage end to be electrically connected to the first light-emitting module according to the first control signal; and when the first drive voltage is greater than the second drive voltage, the first drive-voltage end, the first conduction-control module, the first voltage-stabilizing module, the first light-emitting module, the second conduction-control module, and the second drive-voltage end cooperate to form an output loop to drive the first light-emitting module to emit light.

5. The display panel of claim 4, wherein the first display unit further comprises a first connection module, wherein the first connection module is connected between the first light-emitting module and the second display unit and is configured to receive a first conduction signal, and configured to transfer, under the control of the first conduction signal, electric charges that remain in the first light-emitting module to the second display unit for image display when the light emission of the first light-emitting module ends.

6. The display panel of claim 2, wherein the second display unit comprises a second signal-receiving module, a second voltage-stabilizing module, and a second light-emitting module, wherein the second signal-receiving module is connected to a data line of the plurality of data lines and a scan line of the plurality of scan lines, and is configured to receive a scan signal through the scan line, receive a data signal through the data line, and transfer the data signal to the second voltage-stabilizing module; the second voltage-stabilizing module is connected to the second signal-receiving module and the second light-emitting module, and is configured to receive and store the data signal from the second signal-receiving module, and apply a stable voltage to the second light-emitting module during light emission of the second light-emitting module; and the second light-emitting module is configured to emit light when the second light-emitting module is connected to the first drive-voltage end and the second drive-voltage end.

7. The display panel of claim 6, wherein the second display unit further comprises a third conduction-control module and a fourth conduction-control module, wherein the third conduction-control module is connected to the second voltage-stabilizing module and the second drive-voltage end and configured to receive a second control signal, and configured to control, according to the second control signal, the second drive-voltage end to be electrically connected to the second voltage-stabilizing module and to be electrically connected to the second light-emitting module through the second voltage-stabilizing module;

the fourth conduction-control module is connected to the second light-emitting module and the first drive-voltage end and is configured to receive the second control signal, and configured to control the first drive-voltage end to be electrically connected to the second light-emitting module according to the second control signal; and when the second drive voltage is greater than the first drive voltage, the second drive-voltage end, the third conduction-control module, the second voltage-stabilizing module, the second light-emitting module, the fourth conduction-control module, and the first drive-voltage end cooperate to form an output loop to drive the second light-emitting module to emit light.

8. The display panel of claim 7, wherein the second display unit further comprises a second connection module, wherein the second connection module is connected between the second light-emitting module and the first display unit and is configured to receive a second conduction signal, and configured to transfer, under the control of the second conduction signal, electric charges that remain in the second light-emitting module to the first display unit for image display when the light emission of the second light-emitting module ends.

9. A display module, comprising a data drive circuit, a scan drive circuit, a display control circuit, a light-emitting controller, and a display panel comprising a plurality of pixel units arranged in a matrix, wherein each of the plurality of pixel units comprises a first display unit, a second display unit, and an adjustment unit, wherein the first display unit and the second display unit are connected in parallel between a first drive-voltage end and a second drive-voltage end, the first drive-voltage end is configured to receive a first drive voltage, and the second drive-voltage end is configured to receive a second drive voltage;

during continuous display of two frames of images, when a first frame of image in the two frames of images is displayed, the first drive voltage is greater than the second drive voltage, and the first drive voltage and the second drive voltage cooperate to drive the first display unit to perform image display; when a second frame of image in the two frames of images is displayed, the second drive voltage is greater than the first drive voltage, and the first drive voltage and the second drive voltage cooperate to drive the second display unit to perform image display;

the first display unit and the second display unit are configured to alternately display a plurality of frames of images under driving of the first drive voltage and the second drive voltage;

the adjustment unit is connected to the first display unit and the second display unit in parallel between the first drive-voltage end and the second drive-voltage end, and configured to make the first drive-voltage end and the second drive-voltage end be in electrical conduction when display of the first image is completed and the second image is not displayed, during the continuous display of the two frames of images, to balance electric charges between the first drive-voltage end and the second drive-voltage end; and the data drive circuit is configured to receive a source output control signal from the display control circuit and to output the data signals according to the source output control signal, the scan drive circuit is configured to receive a gate output control signal from the display control circuit and to output scan signals according to the gate output control signal, and the plurality of pixel units in the display panel are configured to perform image display according to the scan signals and the data signals under the control of the light-emitting controller.

10. The display module of claim 9, the display panel further comprises a plurality of scan lines extending in a first direction and a plurality of data lines extending in a second direction, the first direction is perpendicular to the second direction, the plurality of pixel units are located at intersections between the plurality of scan lines and the plurality of data lines, and the plurality of pixel units are configured to receive scan signals through the scan lines and to receive the data signals for image display under the control of the scan signals.

11. The display module of claim 10, wherein the first display unit comprises a first signal-receiving module, a first voltage-stabilizing module, and a first light-emitting module, wherein the first signal-receiving module is connected to a data line of the plurality of data lines and a scan line of the plurality of scan lines, and is configured to receive a scan signal through the scan line, receive a data signal through the data line, and transfer the data signal to the first voltage-stabilizing module; the first voltage-stabilizing module is connected to the first signal-receiving module and the first light-emitting module, and is configured to receive and store the data signal from the first signal-receiving module, and to apply a stable voltage to the first light-emitting module during light emission of the first light-emitting module; and the first light-emitting module is configured to emit light when the first drive voltage and the second drive voltage are applied to the first light-emitting module.

12. The display module of claim 11, wherein the first display unit further comprises a first conduction-control module and a second conduction-control module, wherein the first conduction-control module is connected to the first voltage-stabilizing module and the first drive-voltage end and configured to receive a first control signal, and configured to control, according to the first control signal, the first drive-voltage end to be electrically connected to the first voltage-stabilizing module and to be electrically connected to the first light-emitting module through the first voltage-stabilizing module;

the second conduction-control module is connected to the first light-emitting module and the second drive-voltage end and is configured to receive the first control signal, and configured to control the second drive-voltage end to be electrically connected to the first light-emitting module according to the first control signal; and when the first drive voltage is greater than the second drive voltage, the first drive-voltage end, the first conduction-control module, the first voltage-stabilizing module, the first light-emitting module, the second conduction-control module, and the second drive-voltage end cooperate to form an output loop to drive the first light-emitting module to emit light.

13. The display module of claim 12, wherein the first display unit further comprises a first connection module, wherein the first connection module is connected between the first light-emitting module and the second display unit and is configured to receive a first conduction signal, and configured to transfer, under the control of the first conduction signal, electric charges that remain in the first light-emitting module to the second display unit for image display when the light emission of the first light-emitting module ends.

14. The display module of claim 10, wherein the second display unit comprises a second signal-receiving module, a second voltage-stabilizing module, and a second light-emitting module, wherein the second signal-receiving module is connected to a data line of the plurality of data lines and a scan line of the plurality of scan lines, and is configured to receive a scan signal through the scan line, receive a data signal through the data line, and transfer the data signal to the second voltage-stabilizing module; the second voltage-stabilizing module is connected to the second signal-receiving module and the second light-emitting module, and is configured to receive and store the data signal from the second signal-receiving module, and apply a stable voltage to the second light-emitting module during light emission of the second light-emitting module; and the second light-emitting module is configured to emit light when the second light-emitting module is connected to the first drive-voltage end and the second drive-voltage end.

15. The display module of claim 14, wherein the second display unit further comprises a third conduction-control module and a fourth conduction-control module, wherein the third conduction-control module is connected to the second voltage-stabilizing module and the second drive-voltage end and configured to receive a second control signal, and configured to control, according to the second control signal, the second drive-voltage end to be electrically connected to the second voltage-stabilizing module and to be electrically connected to the second light-emitting module through the second voltage-stabilizing module;

the fourth conduction-control module is connected to the second light-emitting module and the first drive-voltage end and is configured to receive the second control signal, and configured to control the first drive-voltage end to be electrically connected to the second light-emitting module according to the second control signal; and when the second drive voltage is greater than the first drive voltage, the second drive-voltage end, the third conduction-control module, the second voltage-stabilizing module, the second light-emitting module, the fourth conduction-control module, and the first drive-voltage end cooperate to form an output loop to drive the second light-emitting module to emit light.

16. The display module of claim 15, wherein the second display unit further comprises a second connection module, wherein the second connection module is connected between the second light-emitting module and the first display unit and is configured to receive a second conduction signal, and configured to transfer, under the control of the second conduction signal, electric charges that remain in the second light-emitting module to the first display unit for image display when the light emission of the second light-emitting module ends.

17. A display device, comprising a support frame, a power supply module, and a display module, wherein the display module comprises a data drive circuit, a scan drive circuit, a display control circuit, a light-emitting controller, and a display panel comprising a plurality of pixel units arranged in a matrix;

each of the plurality of pixel units comprises a first display unit, a second display unit, and an adjustment unit, wherein the first display unit and the second display unit are connected in parallel between a first drive-voltage end and a second drive-voltage end, the first drive-voltage end is configured to receive a first drive voltage, and the second drive-voltage end is configured to receive a second drive voltage;

during continuous display of two frames of images, when a first frame of image in the two frames of images is displayed, the first drive voltage is greater than the second drive voltage, and the first drive voltage and the second drive voltage cooperate to drive the first display unit to perform image display; when a second frame of image in the two frames of images is displayed, the second drive voltage is greater than the first drive voltage, and the first drive voltage and the second drive voltage cooperate to drive the second display unit to perform image display;

the first display unit and the second display unit are configured to alternately display a plurality of frames of images under driving of the first drive voltage and the second drive voltage;

the adjustment unit is connected to the first display unit and the second display unit in parallel between the first drive-voltage end and the second drive-voltage end, and configured to make the first drive-voltage end and the second drive-voltage end be in electrical conduction when display of the first image is completed and the second image is not displayed, during the continuous display of the two frames of images, to balance electric charges between the first drive-voltage end and the second drive-voltage end;

the data drive circuit is configured to receive a source output control signal from the display control circuit and to output the data signals according to the source output control signal, the scan drive circuit is configured to receive a gate output control signal from the display control circuit and to output scan signals according to the gate output control signal, and the plurality of pixel units in the display panel are configured to perform image display according to the scan signals and the data signals under the control of the light-emitting controller; and the power supply module is configured to apply a power supply voltage to the display panel to perform image display, and the display module and the power supply module are fixed to the support frame.

18. The display device of claim 17, wherein the display panel further comprises a plurality of scan lines extending in a first direction and a plurality of data lines extending in a second direction, the first direction is perpendicular to the second direction, the plurality of pixel units are located at intersections between the plurality of scan lines and the plurality of data lines, and the plurality of pixel units are configured to receive scan signals through the scan lines and to receive the data signals for image display under the control of the scan signals.

19. The display device of claim 18, wherein the first display unit comprises a first signal-receiving module, a first voltage-stabilizing module, and a first light-emitting module, wherein the first signal-receiving module is connected to a data line of the plurality of data lines and a scan line of the plurality of scan lines, and is configured to receive a scan signal through the scan line, receive a data signal through the data line, and transfer the data signal to the first voltage-stabilizing module; the first voltage-stabilizing module is connected to the first signal-receiving module and the first light-emitting module, and is configured to receive and store the data signal from the first signal-receiving module, and to apply a stable voltage to the first light-emitting module during light emission of the first light-emitting module; and the first light-emitting module is configured to emit light when the first drive voltage and the second drive voltage are applied to the first light-emitting module.

20. The display device of claim 19, wherein the first display unit further comprises a first conduction-control module and a second conduction-control module, wherein the first conduction-control module is connected to the first voltage-stabilizing module and the first drive-voltage end and configured to receive a first control signal, and configured to control, according to the first control signal, the first drive-voltage end to be electrically connected to the first voltage-stabilizing module and to be electrically connected to the first light-emitting module through the first voltage-stabilizing module;

the second conduction-control module is connected to the first light-emitting module and the second drive-voltage end and is configured to receive the first control signal, and configured to control the second drive-voltage end to be electrically connected to the first light-emitting module according to the first control signal; and when the first drive voltage is greater than the second drive voltage, the first drive-voltage end, the first conduction-control module, the first voltage-stabilizing module, the first light-emitting module, the second conduction-control module, and the second drive-voltage end cooperate to form an output loop to drive the first light-emitting module to emit light.

* * * * *